US006474609B1

(12) United States Patent
Pinard

(10) Patent No.: US 6,474,609 B1
(45) Date of Patent: Nov. 5, 2002

(54) DRAPERY HANGING DEVICE

(76) Inventor: Jean Pinard, 29 Deauville, Blainville, Quebec (CA), J7C 3V2

( * ) Notice: Subject to any disclaimer, the term of this patent is extended or adjusted under 35 U.S.C. 154(b) by 16 days.

(21) Appl. No.: 09/721,123

(22) Filed: Nov. 22, 2000

Related U.S. Application Data

(60) Provisional application No. 60/166,793, filed on Jul. 22, 1999.

(51) Int. Cl.[7] ..... A47H 1/16; A47H 13/14

(52) U.S. Cl. ..... 248/303; 248/294.1; 160/348; 160/349.2

(58) Field of Search ..... 248/303, 302, 248/316.1, 316.5, 294.1; 160/348, 349.2

(56) References Cited

U.S. PATENT DOCUMENTS 1,209,613 A * 12/1916 Neumaster ..... 248/294.1
1,894,895 A * 1/1933 Steele et al. ..... 248/72
2,236,017 A * 3/1941 Stratton ..... 160/123
2,329,446 A * 9/1943 Whitehead et al. ..... 160/349.2
2,431,934 A * 12/1947 Higgins ..... 169/349.2
3,901,303 A * 8/1975 Falkenberg ..... 160/348
5,141,045 A * 8/1992 Williams ..... 160/348
5,316,067 A * 5/1994 LeClaire ..... 160/348
D357,624 S * 4/1995 Ferdman ..... D8/368
5,775,401 A * 7/1998 Faurie ..... 160/349.2
5,927,371 A * 7/1999 Schofield et al. ..... 160/348

* cited by examiner

*Primary Examiner*—Anita King
(74) *Attorney, Agent, or Firm*—Eric Fincham

(57) ABSTRACT

A drapery hanging device which has first and second members, the members being formed of an elongated rod material, the first and second members being pivotably connected with a drapery receiving section therebetween. The arrangement permits easy mounting of the drapery fabric and also permits adjustment thereof.

9 Claims, 5 Drawing Sheets

DRAPERY HANGING DEVICE

This application claims benefit of provisional application No. 60/166,793 filed Jul. 22, 1999.

The present invention relates to an assembly for hanging drapes and more particularly, relates to a hanging device for drapes.

BACKGROUND OF THE INVENTION

The use of members which are mounted on walls for supporting drapery fabrics is known in the art. The idea behind the use of such members or devices is to provide a holder which extends parallel to the wall or window to be draped; a curtain fabric is then placed between two of such holders in what is frequently referred to as a swag arrangement.

The swag drape will then require, as a minimum, first and second hanging devices situated proximate the upper corners of the window frame and secured either to the window frame or to the wall. Each device will normally extend outwardly away from the wall a distance sufficient to clear the traverse rods employed to support the curtain. Clips, springs or other securing devices are used in conjunction with conventional devices to retain the drapery material in a fixed relationship to the brackets once the drapery material has been passed thereover.

Many different brackets have been proposed in the art to address the problems encountered in hanging drapes. Thus, one may refer to U.S. Pat. No. 2,431,934 which discloses a bracket for supporting and securing a drapery in a predetermined position.

Another type of drapery bracket is shown in U.S. Pat. No. 4,284,258 wherein there is provided a festoon support device including a pair of mounting brackets and a forwardly extending festoon support arm coupled to each of the brackets.

A further type of device for draping curtains or the like is shown in U.S. Pat. No. 5,343,925 wherein there is a holder about which curtain fabric may be put and which is adapted to be mounted on a wall by means of a bracket in a spaced relationship to the wall. The holder is a round or flat bar bent to a desired shape.

A further type of holder which is commercially available comprises a spiral arrangement of an elongated bar or rod. The curtain fabric is placed in between the spiral and retained thereby.

One of the problems with such holders is that the holder, once attached to the wall, becomes difficult to work with especially when the installer is working on a ladder or stool or the like.

A further problem associated with known holders is their unsuitability for attachment to any surface other than the window frame or the surrounding wall. Frequently, it would be desirable to secure the holder to the ceiling when the window or other portion to be decorated extends substantially up to the ceiling.

A still further problem associated with known brackets or holders is the problem of adjusting the fabric while it is in the holder.

SUMMARY OF THE INVENTION

It is therefore an object of the present invention to provide a drapery support assembly wherein a drapery hanging device may be attached to either the ceiling or wall.

It is a further object of the present invention to provide a drapery support device which allows for easy mounting of the drapery fabric therein and also permits adjustment of the drapery fabric.

According to one aspect of the present invention, there is provided a drapery hanging device comprising a first member, the first member having first and second spaced apart sections, the first and second spaced apart sections defining a drapery receiving portion therebetween, a second member, the second member having an attachment portion at one end thereof for attachment to a support member, the second member being pivotably connected at a second end thereof to the first member.

According to a further aspect of the present invention, there is provided a drapery hanging assembly comprising a holder and a drapery hanging device, the holder having attachment means for attaching the holder to a substrate, the holder having first and second rod receiving means, the drapery device comprising a first member formed of an elongated rod, the first member having first and second spaced apart sections, the first and second spaced apart sections defining a drapery receiving portion therebetween, a second member formed of an elongated rod, the first portion of the first member and second member having at respective ends thereof attachment portions sized to fit in the first rod receiving means and be retained thereby, the second member being pivotably connected at a second end thereof to the first member.

According to a still further aspect of the present invention, there is a window draping assembly comprising a drape, a holder and a drapery hanging device, the holder being secured to a substrate adjacent the window, the holder having first and second rod receiving means, the drapery device comprising a first member formed of an elongated rod, the first member having first and second spaced apart sections, the first and second spaced apart sections defining a drapery receiving portion therebetween, a second member formed of an elongated rod, the first portion of the first member and the second member having at respective ends thereof an attachment portion fitting within the first and second rod receiving means respectively, the second member being pivotably connected at a second end thereof to the first member, the drapes being retained between the first and second spaced apart sections.

The drapery hanging device of the present invention may be utilized in any situation wherein a fabric is to be hung. This may include, for example, drapery around windows or in other locations. The device of the present invention could be utilized to hang draperies from any wall or ceiling or post—for example, it may be used to hang drapery on a four poster bed.

The drapery device is preferably formed of a rod like material. The material could be any suitable including plastic or metallic material—a non-tarnishing metallic material is one example. When formed of a plastic material, the device could be offered in a variety of colors. Alternatively, a surface coating of the desired color could be utilized.

The drapery hanging device, in the preferred embodiment, being formed of a rod like material, permits various decorative effects to be achieved. The use of the rod like material permits the drapery material to be pulled through the spaces to achieve the desired effects.

The drapery hanging assembly includes a holder which is secured to the desired substrate and which holder has first and second rod receiving means.

BRIEF DESCRIPTION OF THE DRAWINGS

Having thus generally described the invention, reference will be made to the accompanying drawings illustrating embodiments thereof, in which.

DESCRIPTION OF THE PREFERRED EMBODIMENTS

Figure 1:
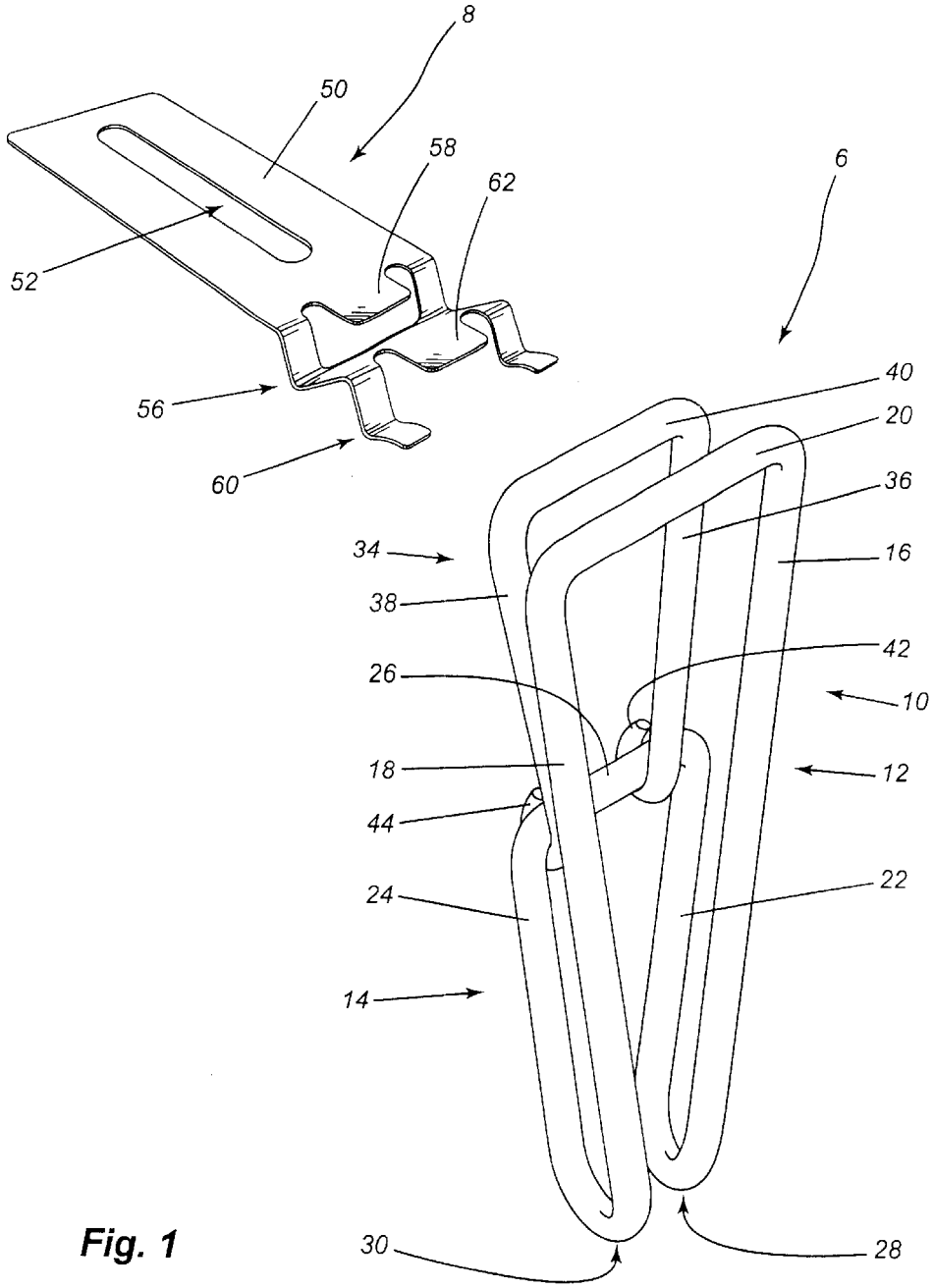
FIG. 1 is a perspective view of a first embodiment of a drapery hanging assembly according to the present invention.

Referring to the drawings in greater detail and by reference characters thereto, there is illustrated in FIG. 1 a drapery hanging device generally designated by reference numeral 6 and a holder generally designated by reference numeral 8.

Drapery hanging device 6 includes a first member which is generally designated by reference numeral 10. First member 10 has a first section generally designated by reference numeral 12 and a second section which is generally designated by reference numeral 14.

As may be seen in FIG. 1, first section 12 is formed of a first section first arm 16, a first section second arm 18, and a first section connecting segment 20 extending between arms 16 and 18. Thus, first section 12 has an overall inverted V or U shaped configuration.

Second section 14 is formed of a second section first arm 22, a second section second arm 24, and a second section connecting segment 26. In a manner similar to first section 12, second section 14 likewise has an inverted V or U shaped configuration. It will be noted, however, that second section 14 is substantially smaller than first section 12.

As seen in FIG. 1, first section first arm 16 and second section first arm 22 are connected by a transition segment 28 while first section second arm 18 and second section second arm 24 are connected by a transition segment 30.

Drapery hanging device 6 also includes a second member generally designated by reference numeral 34. Second member 34 is formed of a second member first arm 36, a second member second arm 38, and a second member connecting segment 40 extending between arms 36 and 38. At the distal end of second member first arm 36 and second member second arm 38, the arms are formed into loops 42 and 44 respectively.

Thus, as may be seen, second member 34 is connected to first member 10 by means of loops 42 and 44 encircling second section connecting segment 26 to thereby permit pivotable movement between the first member 10 and second member 34.

Defined between the lower portion of first section 12 of first member 10 and second section 14 is a drapery receiving portion generally designated by reference numeral 46. Drapery receiving portion 46 also includes that area between the upper portion of first section 12 and second member 34.

As aforementioned, the drapery hanging device 6 is designed to be used with a holder 8. Holder 8 includes a body portion 50 of a generally rectangular configuration which has an elongated slot 52 formed therein. At the other end of holder 8, there is provided a first indented V shaped recess 56 having a tab 58 extending partially thereover. There is also provided a second V shaped recess 60 with tab 62.

Figure 2:
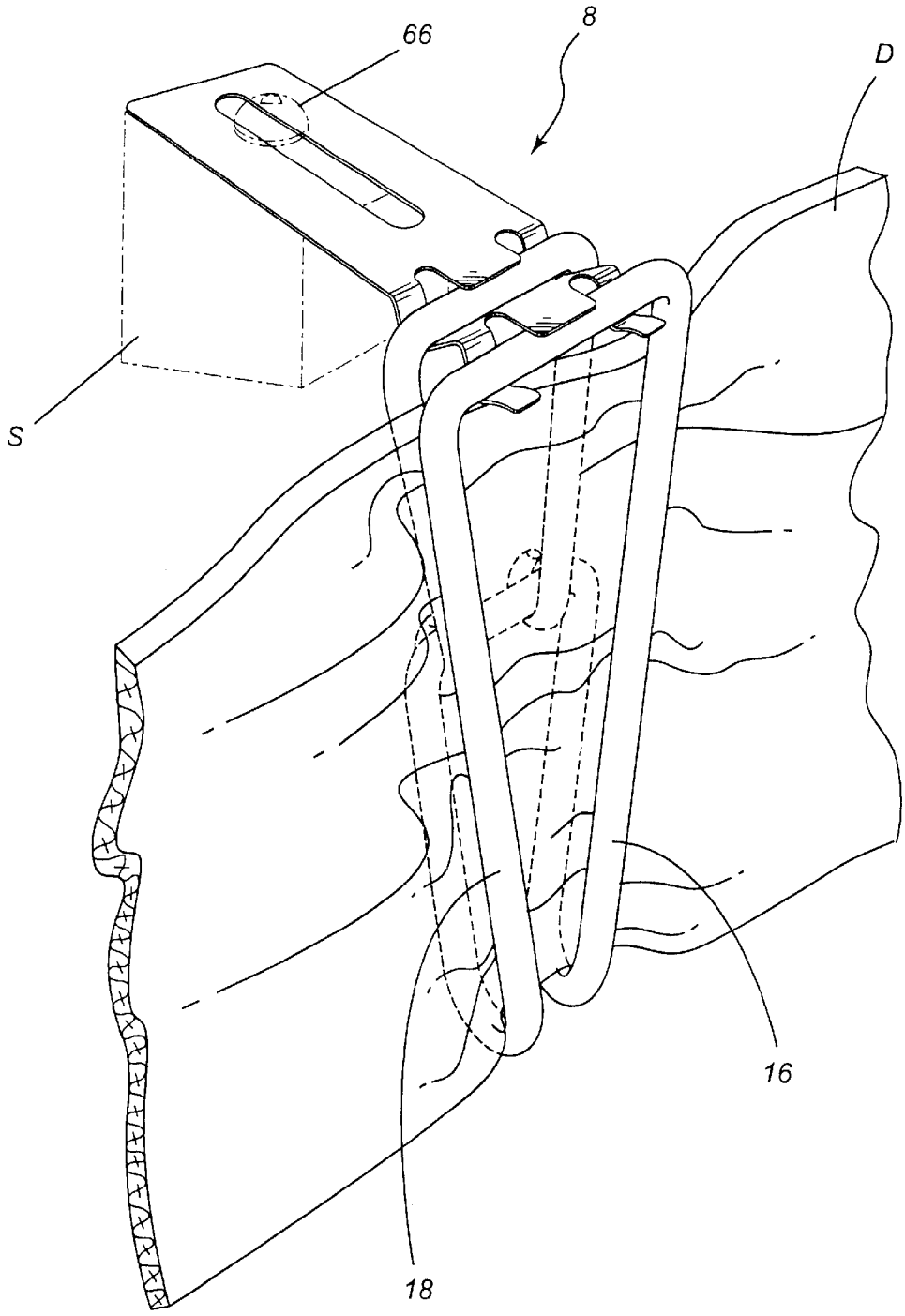
FIG. 2 is a perspective view illustrating the assembly when in an assembled condition.

In use, and as shown in FIG. 2, holder 8 may be secured to a substrate S by means of a screw 66. Initially, connecting segment 40 of second member 34 is placed within V shaped recess 56. First member 10 may then be lowered and the drapery material D arranged. When arranged to achieve the desired effect, first member 10 is moved upwardly and connecting segment 20 is placed within V shaped recess 60.

Figure 3:
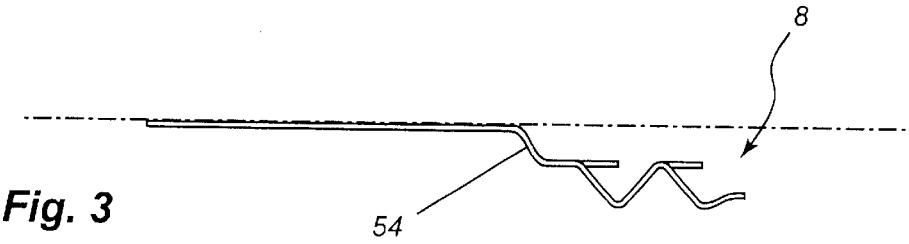
FIG. 3 is a side elevational view of a retaining clip according to one embodiment of the present invention.
Figure 4:
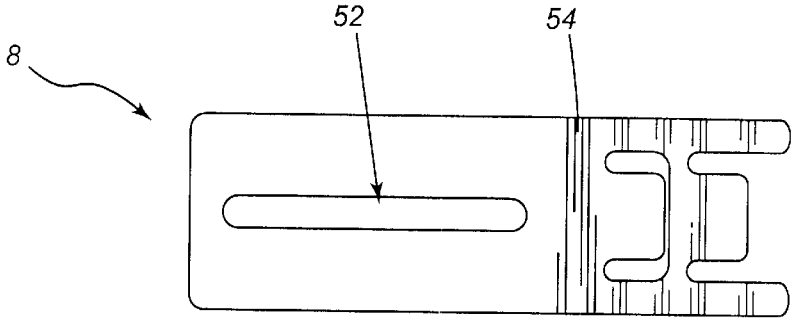
FIG. 4 is a top plan view thereof.
Figure 5:
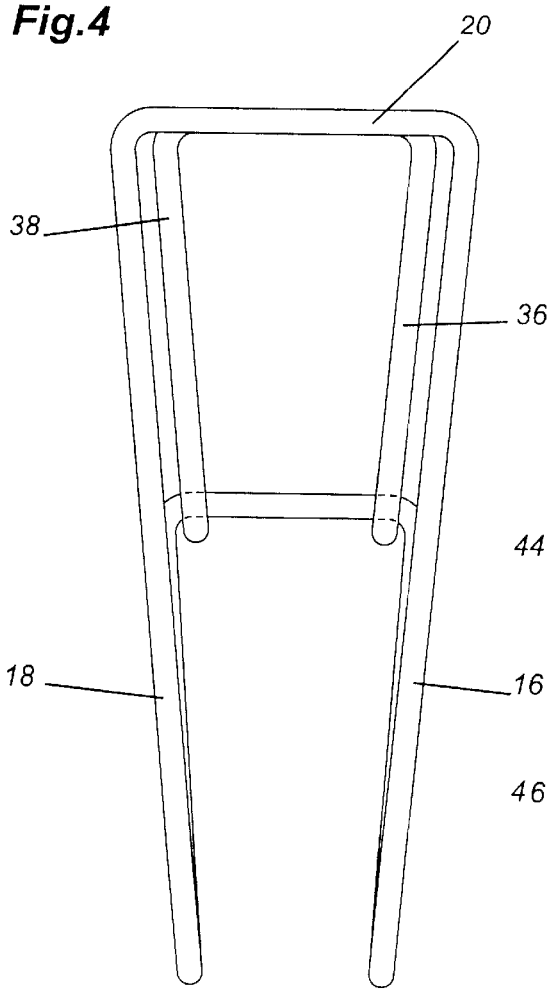
FIG. 5 is a front elevational view of the drapery hanging device according to the present invention.
Figure 6:
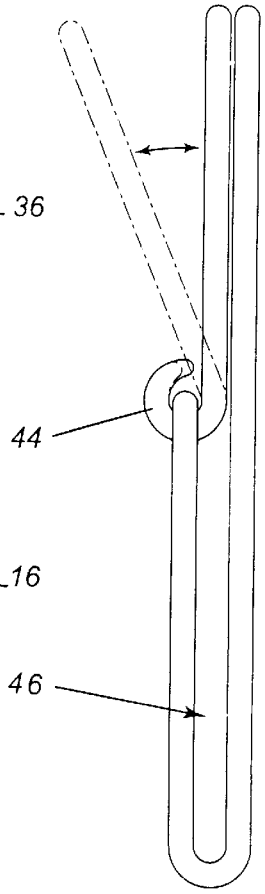
FIG. 6 is a side elevational view thereof.
Figure 7:
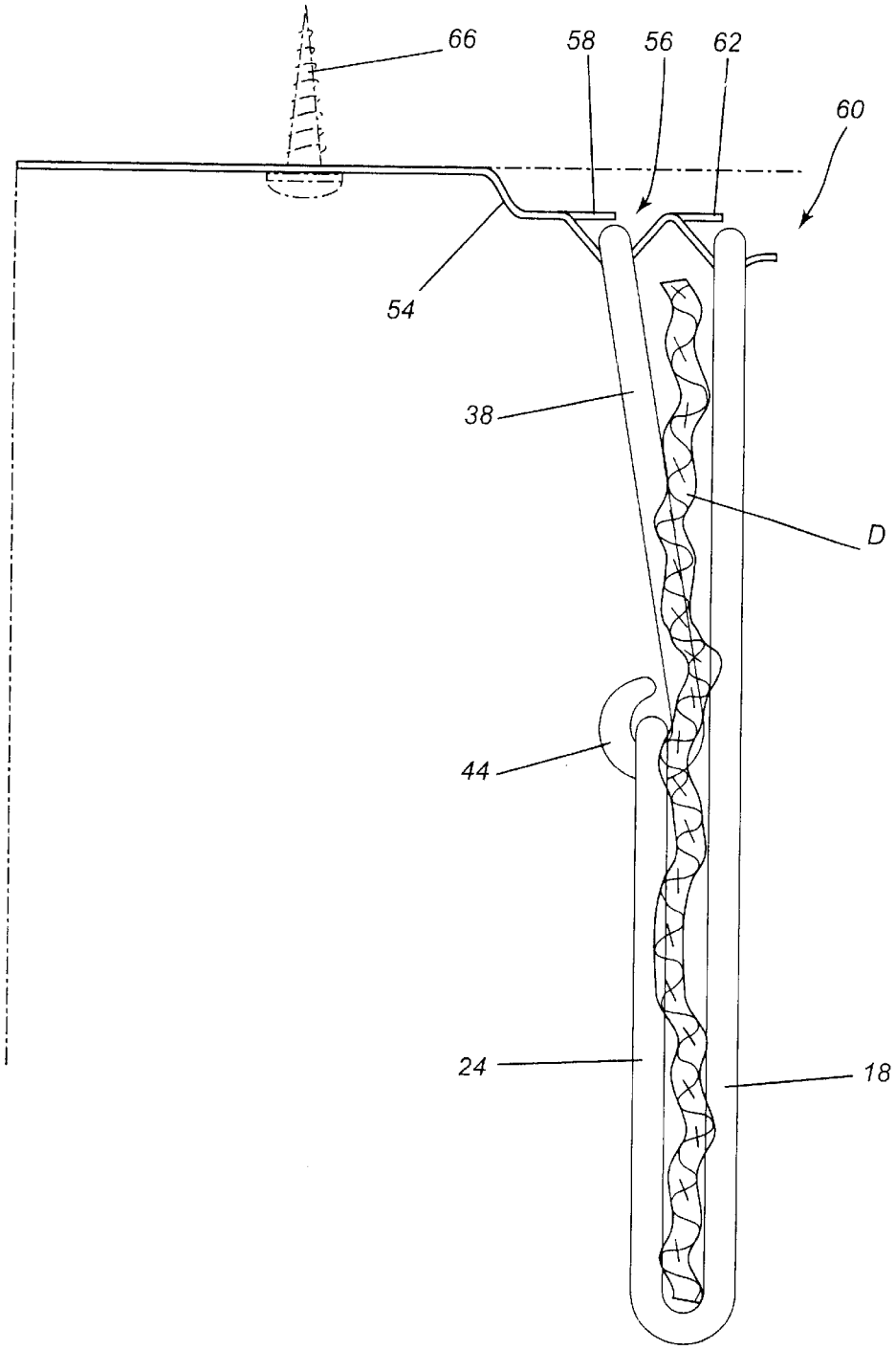
FIG. 7 is a side elevational view showing the drapery hanging device in an assembled condition.

In the arrangement of FIG. 3, there is illustrated a holder 8' which is similar to holder 8. However, holder 8' is provided with a downwardly extending portion 54' such that it may be secured to a ceiling and still provide access to V shaped recesses 56' and 60'.

Figure 8:
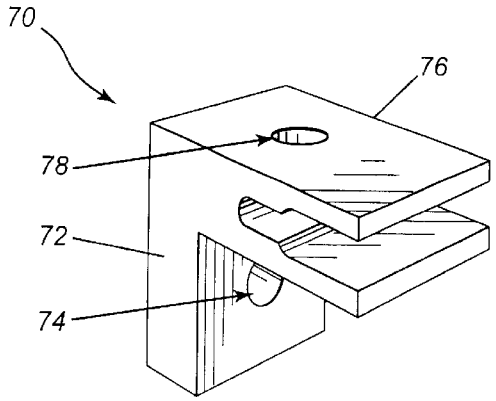
FIG. 8 is a perspective view of a further embodiment of a retaining member according to the present invention.
Figure 10:
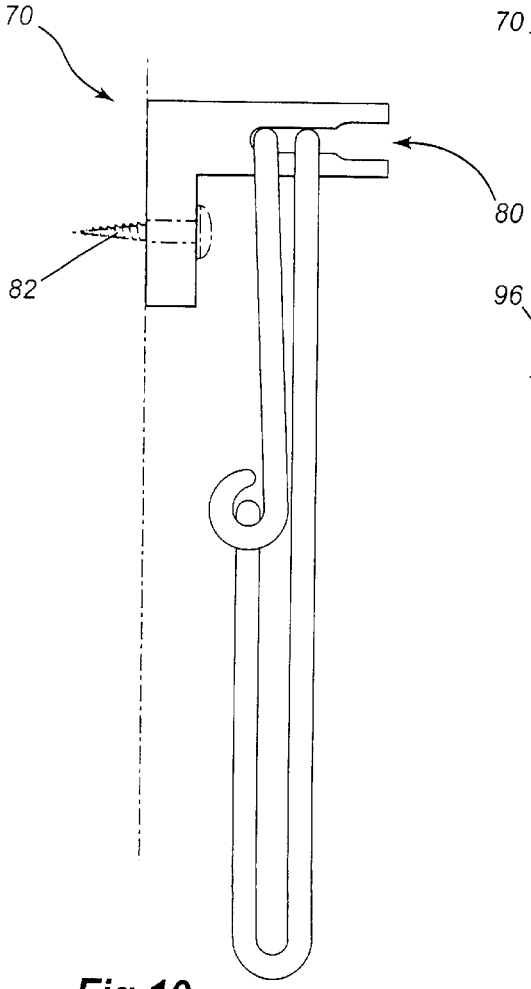
FIG. 10 is a side elevational view of the retaining device of FIG. 8 used in conjunction with the drapery hanging device.

In FIG. 8, there is shown a different type of holder—an L shaped holder generally designated by reference numeral 70. L shaped holder 70 includes a first leg 72 having an aperture 74 formed therein and leg 76 having aperture 78 formed therein. Within leg 76 there is provided a channel 80 which, as seen in FIG. 10, is sized to receive and retain connecting segments 40 and 20. L shaped holder 70 may be attached to a wall by means of screw 82 or alternatively, to a ceiling through aperture 78.

Figure 9:
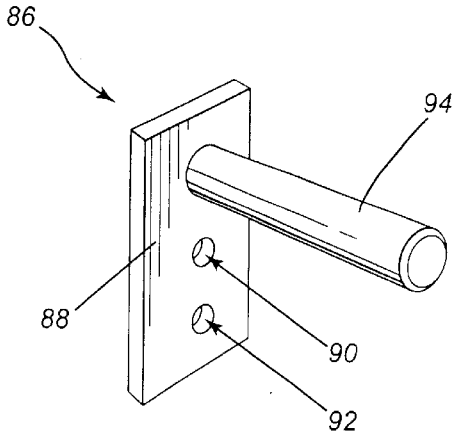
FIG. 9 is a perspective view of a still further embodiment of a retaining device.

A standoff member 86 is illustrated in FIG. 9 and comprises a body portion 88 having apertures 90 and 92 formed therein. A rod 94 extends outwardly from body 88.

Figure 11:
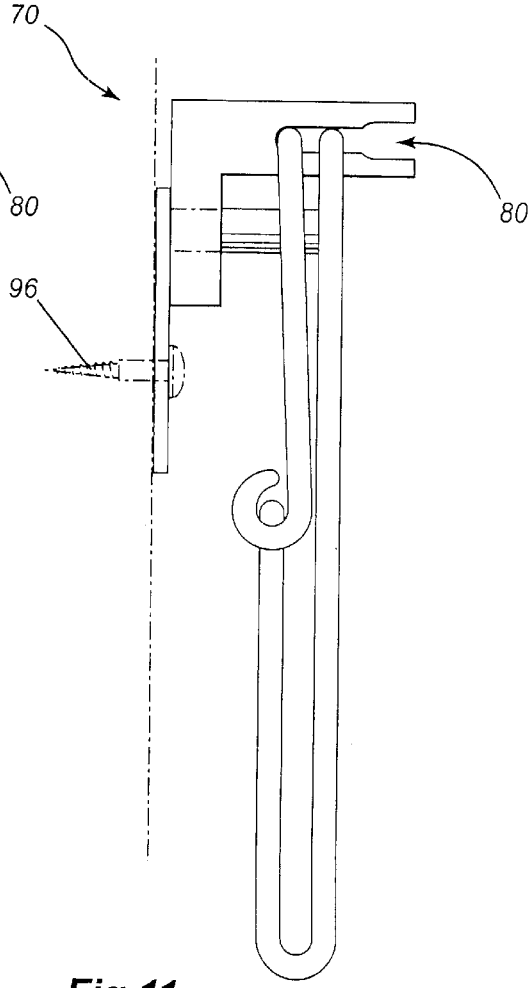
FIG. 11 is a side elevational view of the retaining device of FIG. 9 with the drapery hanging device.

As shown in FIG. 11, standoff member 86 may be used in conjunction with L shaped holder 70 wherein body 88 is secured to a wall or the substrate by means of a screw 96. In turn, member 86 may receive L shaped holder 70.

It will be understood that the above described embodiments are for purposes of illustration only and changes or modifications may be made thereto without departing from the spirit and scope of the invention.

I claim:

1. A drapery hanging device comprising:

a first member, said first member having first and second spaced apart sections, said first and second sections being connected at an end thereof, said first and second sections being generally parallel and defining therebetween a drapery receiving portion;

a second member, said second member having an attachment portion at one end thereof for attachment to a support member, said second member being pivotably connected at a second end thereof to said first member, the arrangement being such that said first member can be pivotably moved to provide access to said drapery receiving portion.

2. The drapery hanging device of claim 1 wherein each of said first and second members are formed of an elongated rod.

3. The drapery hanging device of claim 2 wherein said second member has a generally U shaped configuration defined by a second member first arm, a second member second arm, and a second member connecting segment extending between said arms of said second member, a distal end of said second member first and second arms being pivotably connected to said first member.

4. The drapery hanging device of claim 3 wherein said first section of said first member has a generally U shaped configuration with a first section first arm and a first section second arm and a first section connecting segment extending therebetween, said second section of said first member having a U shaped configuration with a second section first arm and a second section second arm and a connecting segment extending therebetween, said second section connecting segment being pivotably connected to said distal ends of said second member arms and distal end of said first section first and second arms being connected to distal ends of said second section first and second arms.

5. A drapery hanging assembly comprising a holder and a drapery hanging device;

said holder having attachment means for attaching said holder to a substrate, said holder having first and second rod receiving means;

said drapery device comprising a first member formed of an elongated rod, said first member having first and second spaced apart sections, said first and second spaced apart sections defining a drapery receiving portion therebetween, a second member formed of an elongated rod, said first member and said second member having at first respective ends thereof attachment portions sized to fit in said first rod receiving means and be retained thereby, said second member being pivotably connected at a second end thereof to said first member.

6. The drapery hanging assembly of claim 5 wherein said second member has a generally U shaped configuration defined by a second member first arm, a second member second arm, and a second member connecting segment extending between said arms of said second member, a distal end of said second member first and second arms being pivotably connected to said first member.

7. The drapery hanging assembly of claim 6 wherein said first section of said first member has a generally U shaped configuration with a first section first arm and a first section second arm and a first section connecting segment extending therebetween, said second section of said first member having a U shaped configuration with a second section first arm and a second section second arm and a connecting segment extending therebetween, said second section connecting segment being pivotably connected to said distal ends of said second member arms and distal end of said first section first and second arms being connected to distal ends of said second section first and second arms.

8. The drapery hanging assembly of claim 7 wherein said holder and second receiving means of said holder comprise notches formed in a body of said holder.

9. A window draping assembly comprising a drape, a holder and a drapery hanging device, said holder being secured to a substrate adjacent a window, said holder having first and second rod receiving means, said drapery device comprising a first member formed of an elongated rod, said first member having first and second spaced apart sections, said first and second spaced apart sections defining a drapery receiving portion therebetween, a second member formed of an elongated rod, said first member and said second member having at first respective ends thereof an attachment portion fitting within said first and second rod receiving means respectively, said second member being pivotably connected at a second end thereof to said first member, said drapes being retained between said first and second spaced apart sections.

* * * * *

UNITED STATES PATENT AND TRADEMARK OFFICE

CERTIFICATE OF CORRECTION

PATENT NO. : 6,474,609 B1
DATED : November 5, 2002
INVENTOR(S) : Jean Pinard

It is certified that error appears in the above-identified patent and that said Letters Patent is hereby corrected as shown below:

Title page,
Item [60], should read as follows:

-- Provisional application No. 60/166,793, filed on November 22, 1999. --

Signed and Sealed this

Eighth Day of April, 2003

JAMES E. ROGAN
*Director of the United States Patent and Trademark Office*